United States Patent [19]

Williams et al.

[11] 4,013,571

[45] Mar. 22, 1977

[54] EXTREME PRESSURE LUBRICATING COMPOSITION CONTAINING THIOSULFINATE EXTREME PRESSURE AGENTS

[75] Inventors: Ralph P. Williams; Rector P. Louthan, both of Bartlesville, Okla.

[73] Assignee: Phillips Petroleum Company, Bartlesville, Okla.

[22] Filed: Jan. 24, 1975

[21] Appl. No.: 543,792

[52] U.S. Cl. ..... 252/42; 252/45

[51] Int. Cl.[2] ..... C10M 1/24

[58] Field of Search ..... 252/33, 33.6, 42, 45, 252/42.1

[56] References Cited

UNITED STATES PATENTS

| | | | |
|---|---|---|---|
| 2,110,281 | 3/1938 | Adams et al. | 252/45 |
| 2,431,010 | 11/1947 | Zimmer | 252/45 X |
| 2,574,829 | 11/1951 | Himel et al. | 260/455 |
| 3,267,033 | 8/1966 | Allen | 252/32.7 E |
| 3,481,871 | 12/1969 | Myers et al. | 252/45 |
| 3,873,454 | 3/1975 | Horodysky et al. | 252/454 |
| 3,928,217 | 12/1975 | Labat et al. | 252/45 |

OTHER PUBLICATIONS

Smalheer et al., "Lubricant Additives", 1967, pp. 9–11, Extreme Pressure Additives.

*Primary Examiner*—Delbert E. Gantz
*Assistant Examiner*—Andrew M. Metz

[57] ABSTRACT

An extreme pressure lubricant composition comprising a lubricating oil containing O-ethyl-S-n-butylthiosulfenyl xanthate, O-ethyl-S-tert-butyl-thiosulfenyl xanthate, t-butyl-t-butylthiosulfinate, or a polymeric polysulfide of a mercaptoethyl cyclohexane thiol.

5 Claims, No Drawings

EXTREME PRESSURE LUBRICATING COMPOSITION CONTAINING THIOSULFINATE EXTREME PRESSURE AGENTS

This invention relates to new lubricating compositions. More particularly, this invention relates to lubricating compositions of the type known in the art as "extreme pressure lubricants," such as for example, those lubricants which will perform satisfactorily under the extreme pressures that are common to the lubrication of hypoid gears, bearing surfaces, and metal cutting tools.

The present day trend in automotive design is toward smaller rear axles and consequently smaller gears. On account of the small gears, tooth pressures and rubbing velocities are rapidly approaching a point where rear axles cannot be lubricated satisfactorily with the ordinary mineral lubricating oils. The trend toward increasing loads on gear teeth in other fields has developed an urgent need for special lubricants. When hypoid gears, worm gears, heavy duty bearings, planetary automatic shifts, and the like are used under conditions of high pressure and high rubbing velocities, special types of extreme pressure lubricants must be provided in order to reduce the wear upon such moving parts. Extreme pressure lubricants are likewise important in cutting and drawing operations where the oil must withstand high pressures encountered under those conditions of use.

It is known, that one class of compositions designed for use as "extreme pressure lubricants" comprises mineral lubricating oils to which have been added, preferably in the oil-soluble form, sufficient amounts of various surface active agents in the form of metallic soaps, notably lead soaps. A more restrictive use of materials containing elements such as lead, zinc, and phosphorus in lubricating oils and greases is predicted because of possible deleterious effects these materials may have on automobile catalyst-type muffler systems and the ecology in general. It is therefore important to develop extreme-pressure lubricating compositions which do not employ such metal compounds.

Another technique for producing extreme pressure lubricating compositions has been the employment of sulfur in the lubricating compositions, either as free sulfur or in a combined form.

It is an object of this invention to provide an extreme pressure lubrication composition embodying organic additives containing combined sulfur which have not until this invention been recognized as effective extreme-pressure lubricant additives by others skilled in the art.

In accordance with instant invention, the following sulfur compounds:

1. a polysulfide of formula

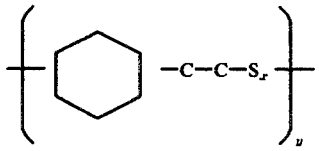

where $x = 2$ to 25

$y = 10$ to 100 made by reacting 3 (and/or 4) - (2-mercaptoethyl) cyclohexanethiol with sulfur as in Examples VI and VIII of U.S. Pat. No. 3,434,852, 2. t-butyl-t-butylthiosulfinate

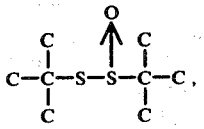

3. O-ethyl-S-tert-butylthiosulfenyl xanthate

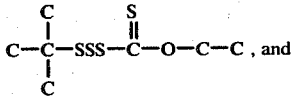

4. O-ethyl-S-n-butylthiosulfenyl xanthate

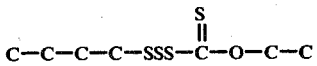

are employed as ashless lubricant additives. The four sulfur compounds improve the antiwear and extreme pressure lubricating properties of oils and greases when incorporated therein. Because instant sulfur compounds are liquids or low melting solids, they are easily blended into oils and greases.

In the preparation of the lubricating compositions containing the instant sulfur compounds, various mineral oils are employed. Generally, these are of petroleum origin and are complex mixtures of many hydrocarbon compounds. Preferably, the mineral oils are refined products such as are obtained by well-known refining processes, such as by hydrogenation, polymerization, dewaxing, etc. Frequently, the oils have a Saybolt viscosity at 100° F in the range from about 60 to 5,000 and a Saybolt viscosity at 210° F of about 30 to 250. The oils can be of the paraffinic, naphthenic, or aromatic types, as well as mixtures of one or more types. The additives of the invention have special advantages when employed with paraffinic types of oils such as are obtained by solvent extraction of a suitable refinery stream. Many suitable mineral oils are available as commercial products such as those used as motor oils, fuel oils, gear oils, automatic transmission oils, and the like.

Generally, also any conventional and commercially available grease can be used in accordance with this invention. The grease employed can have been thickened in any known manner such as by the use of soaps and/or by dissolving polymers in the oil at temperatures of at least 245° F and the like.

Suitable greases include substantially any grade of flowable grease as defined by the National Lubricating Grease Institute (NLGI). For example, NLGI grade greases from 000 to 6 can be employed in this invention. Also, greases having an ASTM D 217–68 penetration at 60 strokes in the range of 85 to 475 can be employed.

The lubricating oil bases which can be employed to make grease of this invention can be mineral, vegetable, or animal in nature, preferably lubricant bases having at least a major amount of mineral origin. Such oils include refined oils having a viscosity of from about 35 to about 240 SUS at 210° F. White mineral oil as well as other specialty oils can be used and are among the preferred oils.

The amount of sulfur compound which is employed in this invention is any amount that will provide the desired improvement in extreme pressure characteristics. Generally this is in the range of from about 0.05 weight per cent to about 10 weight per cent, preferably from about 0.1 to about 5 weight per cent, based on the total weight of the lubricant composition, i.e., the total weight of lubricant plus other additives plus sulfur compound.

Thickeners for the oils can be employed in amounts up to 20 weight per cent of the oil. Various soaps normally used to thicken greases can be used, and they include metal salts of high molecular weight acids, for example, acids of 10 to 30 carbon atoms, and preferably 16 to 24 carbon atoms, either synthetic or of animal or vegetable origin. Other carboxylic acids are useful for making soaps of metal salts include those derived from tallows, hydrogenated fish oil, castor oil, wool grease, and rosin. Generally, the alkali metal or alkaline earth metal or aluminum or lead salts of acids such as lauric, palmitic, oleic, stearic, and the like are used. One of the preferred soaps is the lithium soap of 12-hydroxystearic acid. While soaps of a general nature can be used in the greases of this invention, it should be understood that the invention includes use with soapless greases formed essentially from polymers and oil alone, with or without small amounts of known grease additives such as fillers and the like. Thus, polymers such as polyethylene and polypropylene can be employed as thickeners, together, alone or in conjunction with other thickeners such as soap.

Other materials normally used in greases can also be employed in the greases applicable to this invention. For example, additives such as rust inhibitors, antioxidants, fillers, pigments, perfumes, and the like can be employed. Some examples of such materials include propylenediamine, phenyl-α-naphthylamine, phenothiazine, mica, asbestos, powdered lead, powdered zinc, talc, alumina, titanium dioxide, molybdenum disulfide, bentones, carbon black, nitrobenzene, and the like. Generally, the amount of these modifiers is less than about 10 per cent of the total weight of the grease.

Other agents than those which have been mentioned can be present in the lubricant composition such as dyes, pour point depressants, heat thickened fatty oils, sulfurized fatty oils, sludge dispersers, foam suppressants, thickeners, viscosity index improvers, oiliness agents, resins, rubber, molten polymers, and the like.

EXAMPLE I

A polysulfide of formula

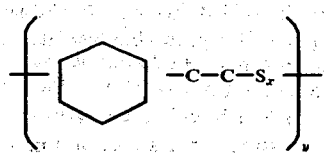

wherein $x = 4$ and $y$ was estimated to be 50 was prepared as in Example VIII of U.S. Pat. No. 3,434,852 by heating sulfur and crude 3(and 4)-(2-mercaptoethyl) cyclohexanethiol in an oil bath at 160° to 170° C for 3 to 4 hours. The resulting polysulfide had a viscosity of about 290 centipoises at 165° C.

A quantity of t-butyl t-butylthiosulfinate, a known compound, was prepared as in Example 2 of U.S. Pat. No. 2,999,105. Also, O-ethyl-S-tert-butylthiosulfenyl xanthate and O-ethyl-S-n-butylthiosulfenyl xanthate were obtained. These compounds may be prepared as illustrated by U.S. Pat. No. 2,574,829. The sample of O-ethyl-S-tert-butylthiosulfenyl xanthate was prepared by reacting tert-butyl mercaptan with sulfur dichloride dissolved in pentane to produce tert-butylthiosulfenyl chloride. To the latter was added an aqueous solution of sodium ethyl xanthate and the mixture stirred to produce the desired compound.

The above sulfur compounds were evaluated as extreme pressure lubricant additives in the Timken O.K. load test (ASTM D 2509–68), using a commercial lithium base grease, Philube L-2. The grease had an NLGI grade of 2 and a penetration at 60 strokes of 275. It was compounded of soap and oil, the soap being lithium-12-hydroxystearate with a minimum concentration of 10 weight per cent. The oil had a minimum flash of 350° F, a viscosity of 75 to 95 SUS at 210° F, and a viscosity index of 50 minimum. The grease contained no additives other than the sulfur compounds, For comparative purposes, the test was also conducted on the grease with no extreme pressure lubricant additive. Tests were also made of samples of the grease containing sulfur compounds of the type previously suggested as lubricant additives, namely, di-tert-butyl disulfide, di-tert-octyl disulfide, and di-n-butylsulfoxide. U.S. Pat. No. 2,318,629 contains the broad teaching that such sulfur containing compounds are useful as extreme pressure additives. The results are shown in Table I below.

TABLE I

Evaluation of Sulfur Compounds as Extreme Pressure Lubricants in Grease

| Test No. | Additive | Additive Conc.,(a) wt. % | Timken O.K.(b) Load, lb. |
|---|---|---|---|
| 1. | None (Pure L-2 Grease) | — | 10 |
| 2. | Polysulfide of Formula 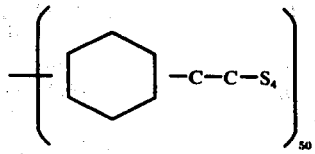 | 3.0 | 35 |
| 3. | t-butyl t-butylthiosulfinate | 3.0 | 40 |
| 4. | O-ethyl-S-tert-butylthiosulfenyl xanthate | 3.0 | 35 |
| 5. | O-ethyl-S-n-butylthiosulfenyl | 3.0 | 40 |

TABLE I-continued

| Evaluation of Sulfur Compounds as Extreme Pressure Lubricants in Grease | | | |
|---|---|---|---|
| Test No. | Additive | Additive Conc.,(a) wt. % | Timken O.K.(b) Load, lb. |
| | xanthate | | |
| 6. | Di-tert-butyl disulfide | 3.0 | 50 |
| 7. | Di-tert-octyl disulfide | 3.0 | 15 |
| 8. | Di-n-butylsulfoxide | 3.0 | 20 |

(a)Concentration as a percentage of total grease, i.e., grease plus sulfur compound.
(b)By test method ASTM D 2509-68

The industry requirements are that grease generally have a Timken O.K. load of at least 30 pounds. The above data indicate the four additives of the invention which have not as yet been recognized as effective extreme pressure lubricant additives by others skilled in the art are indeed effective. The data also indicate that other sulfur compounds, even some of those taught to be extreme pressure additives, are not satisfactory. In fact, the difference in the effectiveness of di-tert-butyl disulfide and di-tert-octyl disulfide indicates one cannot predict with much certainty that all similar sulfur compounds will exhibit similar extreme pressure characteristics.

EXAMPLE II

The effectiveness of O-ethyl-S-tert-butylthiosulfenyl xanthate as an extreme pressure lubricant in gear oil was tested at 3 concentrations. An SMP (Phillips Petroleum Company) gear oil was employed with a viscosity of 870–960 SUS at 100° F (range for such oils is 310 to 2650), a viscosity of 85 to 90 SUS at 210° F (range is 55 to 160) and a viscosity index of 102 minimum (range of 85 to 102 minimum). The results are presented below in Table II.

TABLE II

| Evaluation of Sulfur Chemical as Extreme Pressure Lubricant in Gear Oil | | | |
|---|---|---|---|
| Test No. | Additive | Additive Conc.,(a) wt.% | 4-Ball Weld Load,(b) Kg. |
| 1. | None (Phillips SWP Oil) | — | 110 |
| 2. | O-ethyl-S-tert-butylthiosulfenyl xanthate | 0.25 | 160 |
| 3. | O-ethyl-S-tert-butylthiosulfenyl xanthate | 0.50 | 200 |
| 4. | O-ethyl-S-tert-butylthiosulfenyl xanthate | 1.00 | 240 |

(a)Concentration expressed as percentage of total oil, i.e., oil plus sulfur compound.
(b)By test method ASTM D 2596-69.

The above data illustrate the effectiveness of O-ethyl-S-tert-butylthiosulfenyl xanthate as an extreme pressure additive in gear oil as the industry requires a 4-ball weld load of at least 200 kg.

It is to be understood that the foregoing disclosure and examples are given only as an illustration to enable those skilled in the art to understand and practice the invention. The illustrative details disclosed are not to be construed as limitations on the invention. Obvious modifications and variations will be within the scope of the following claims.

We claim:

1. An extreme pressure lubricant composition comprising a mineral, animal, or vegetable lubricating oil and an amount of t-butyl-t-butylthiosulfinate which imparts improved extreme pressure characteristics to the lubricating oil.

2. A composition in accordance with claim 1 containing about 0.05 to about 10 weight percent of t-butyl-t-butylthiosulfinate based upon the weight of said lubricant composition.

3. A composition in accordance with claim 1 containing about 0.1 to about 5 weight percent of t-butyl-t-butylthiosulfinate based upon the weight of said lubricant composition.

4. A composition in accordance with claim 1 wherein the lubricating oil is present in the form of a lithium-based grease of about 000 to about 6 NLGI grade.

5. The composition of claim 1 wherein the lubricating oil is a mineral oil having a Saybolt viscosity at 210° F of about 30 to about 250.

* * * * *